US007297032B2

(12) United States Patent
Kobayashi et al.

(10) Patent No.: US 7,297,032 B2
(45) Date of Patent: Nov. 20, 2007

(54) COMBINED CONNECTOR

(75) Inventors: Toru Kobayashi, Makinohara (JP); Rikiya Iwasaki, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/522,389

(22) Filed: Sep. 18, 2006

(65) Prior Publication Data

US 2007/0072492 A1 Mar. 29, 2007

(30) Foreign Application Priority Data

Sep. 27, 2005 (JP) ..... P2005-280066

(51) Int. Cl.
*H01R 13/502* (2006.01)

(52) U.S. Cl. ..... 439/701; 439/595

(58) Field of Classification Search ..... 439/595, 439/701, 737–740, 372–381
See application file for complete search history.

(56) References Cited

U.S. PATENT DOCUMENTS

| | | | | |
|---|---|---|---|---|
| 5,288,251 | A * | 2/1994 | Sumida | 439/701 |
| 6,045,409 | A * | 4/2000 | Abe | 439/701 |
| 6,354,887 | B2 * | 3/2002 | Maeda | 439/701 |
| 6,358,098 | B1 * | 3/2002 | Wakata | 439/701 |
| 6,406,335 | B2 * | 6/2002 | Sato et al. | 439/701 |
| 6,488,546 | B2 * | 12/2002 | Sakurai et al. | 439/701 |
| 6,579,129 | B2 * | 6/2003 | Sato | 439/724 |
| 6,589,079 | B2 * | 7/2003 | Kashiyama et al. | 439/595 |
| 6,645,003 | B2 * | 11/2003 | Yoshida et al. | 439/507 |
| 6,773,309 | B1 * | 8/2004 | Shuey | 439/701 |
| 6,814,627 | B2 * | 11/2004 | Yamamoto et al. | 439/701 |
| 6,893,292 | B2 * | 5/2005 | Yamamoto et al. | 439/595 |
| 2002/0076990 | A1 * | 6/2002 | Fujita | 439/701 |

FOREIGN PATENT DOCUMENTS

| | | |
|---|---|---|
| JP | 6-181078 A | 6/1994 |
| JP | 2004-335305 A | 11/2004 |

* cited by examiner

*Primary Examiner*—Briggitte R. Hammond
*Assistant Examiner*—Larisa Tsukerman
(74) *Attorney, Agent, or Firm*—Sughrue Mion, PLLC

(57) ABSTRACT

A combined connector includes a first housing that has a first terminal receiving chamber for receiving a first terminal and a second housing that is stacked on the first housing and has a second terminal receiving chamber for receiving a second terminal. The first housing includes a retaining projection which projects and inserts into the second terminal receiving chamber to retain the second terminal in the second terminal receiving chamber and a terminal retaining portion which retains the first terminal received in the first terminal receiving chamber and is disposed so as to contact with the second housing in a state that the first housing and the second housing are stacked together.

5 Claims, 9 Drawing Sheets

COMBINED CONNECTOR

BACKGROUND OF THE INVENTION

This invention relates to a combined connector, and more particularly to a combined connector including a plurality of stacked housings each having terminal receiving chambers.

For example, a joint connector shown in FIGS. 9 and 10 has been proposed as a combined connector of the type described above (see, for example, JP-A-6-181078). FIG. 9 is an exploded, perspective view of the related joint connector, and FIG. 10 is a vertical cross-sectional view of the joint connector taken along the line I-I of FIG. 9.

As shown in these Figures, the joint connector comprises three male connectors (housings) 51, 52 and 53 stacked together. Terminal receiving chambers are formed in each of the male connectors 51, 52 and 53, and female terminals 71, 72, 73 each fixedly secured to an end portion of a wire 61, 62, 63 are inserted and fitted respectively in the terminal receiving chambers of each male connector. The female terminals 71, 72, 73 are retained within the respective terminal receiving chambers by terminal retaining lances 81, 82, 83 for withdrawal prevention purposes.

A pair of retaining projections 93 and a pair of projection insertion holes 103 for connection to the male connector 52 are provided at a side wall of the male connector 53 facing the male connector 52, the retaining projections 93 being disposed adjacent to the projection insertion holes 103. On the other hand, retaining projection 92*a* are formed on a side wall of the male connector 52 facing the male connector 53, and are so arranged as to be opposed respectively to the projection insertion holes 103 in the male connector 53. Also, projection insertion holes 102 are formed in this side wall of the male connector 52, and are disposed adjacent to the retaining projections 92*a*, and are so arranged as to be opposed respectively to the retaining projections 93 of the male connector 53.

A pair of retaining projections 92*b* for connection to the male connector 51 are formed on a side wall of the male connector 52 facing the male connector 51, and are disposed adjacent to each other. Projection insertion holes 101 are formed in a side wall of the male connector 51 facing the male connector 52, and are so arranged as to be opposed respectively to the retaining projections 92*b* of the male connector 52. Constricted portions of the female terminals 71, 72 and 73 are disposed in registry with the projection insertion holes 101, 102 and 103, respectively, and the female terminals 71, 72 and 73 are retained respectively by the retaining projections 92*b*, 93 and 92*a* in a double manner.

However, in the above joint connector, the retaining projections 92*b* and 93 project upward (in the drawings) in a stacking direction Y1, while the retaining projections 92*a* project downward (in the drawings) in the stacking direction Y1. Therefore, the retaining projections 92*a*, 92*b* and 93 can be arranged on a common plane in the stacking direction Y1. In other words, the retaining projections 92*b* and 93 are offset with respect to the retaining projections 92*b* in a longitudinal direction Y3 of the female terminals 71, 72 and 73.

Therefore, when the constricted portions of the female terminals 71, 72 and 73 are disposed in registry with the projection insertion holes 101, 102 and 103 into which the respective retaining projections 92*b*, 93 and 92*a* are inserted, the distal ends of the female terminals 71 and 72 are offset with respect to the distal ends of the female terminals 73. In FIG. 10, the distal ends of the female terminals 73 are disposed rearwardly of the distal ends of the female terminals 71 and 72 in the longitudinal direction Y3. Therefore, mating male terminals to be fitted respectively into the female terminals 73 need to be made longer than mating male terminals to be fitted respectively into the female terminals 71 and 72. Namely, it has been necessary to prepare the male terminals for exclusive use for connection to the female terminals 73, and this is undesirable from the viewpoint of the cost.

JP-A-2004-335305 discloses a joint connector in which mating male terminals for fitting respectively into female terminals in male connectors have the same length. In this joint connector, however, the female terminals in an uppermost one of the stacked male connectors are not retained in a double manner, and it is feared that the female terminals in the uppermost male connector are withdrawn therefrom.

SUMMARY OF THE INVENTION

With the above problems in view, it is an object of this invention to provide a combined connector in which common mating terminals can be used for connection to all of housings, and besides all of terminals received in the housings can be retained in a double manner, thereby reducing the cost and also enhancing the reliability.

The above problem has been solved by a combined connector of the invention, comprising:

a first housing that has a first terminal receiving chamber for receiving a first terminal; and a second housing that is stacked on the first housing and has a second terminal receiving chamber for receiving a second terminal;

wherein the first housing includes:

a retaining projection which projects and inserts into the second terminal receiving chamber to retain the second terminal in the second terminal receiving chamber; and a terminal retaining portion which retains the first terminal received in the first terminal receiving chamber and is disposed so as to contact with the second housing in a state that the first housing and the second housing are stacked together.

In the above configuration, the terminal retaining portion, formed at the first housing abuts against the second housing, and therefore is prevented from elastically deformed toward the second housing, thereby effecting secondary retaining of the first terminal received in the first housing. On the other hand, the second terminal, received in the second housing, is retained in a secondary manner by the retaining projection formed at the first housing. Therefore, the terminal retaining portion, formed at the first housing, abuts against the second housing to thereby effect the secondary retaining, and by doing so, the first terminal received in the first housing can be retained in a double manner without directly retaining this terminal. Therefore, even when the two terminals, received respectively in the first and second terminal receiving chambers of the first and second housings, are disposed in the respective positions coinciding with each other with respect to the longitudinal direction, both of the two terminals can be retained in a double manner.

Preferably, the first housing and the second housing respectively include engagement portions that are provided on regions vicinity of the retaining projection and the terminal retaining portion. The engagement portions are retainingly engaged with each other.

Preferably, the engagement portions are respectively provided on a partition wall of the first terminal receiving chamber and a part of the second housing corresponding to the petition wall of the first terminal receiving chamber in the state that the first housing and the second housing are stacked together.

Preferably, the second housing includes a protrusion which is disposed so as to be pressed in contact with the terminal retaining portion of the first housing in a state that the first housing and the second housing are stacked together.

In the above configuration, the first housing and the second housing include the respective retaining portions which are retainingly engaged with each other when the retaining projection retains the terminal received in the terminal receiving chamber in the second housing, and the terminal retaining portion abuts against the second housing. With this construction, when the first terminal, received in the first housing, is in a half-inserted condition, that is, when the first terminal is not retained by the terminal retaining portion, the terminal retaining portion is elastically deformed toward the second housing, and the terminal retaining portion and the second housing fail to properly abut against each other, so that the first housing can not be locked to the second housing by the retaining portions. On the other hand, when the terminal, received in the second housing, is in a half-inserted condition, that is, when the terminal is not retained by the retaining projection, the retaining projection can not be inserted into the proper retaining position, and therefore the one and other housings can not be locked to each other by the retaining portions.

As described above, in the invention of claim 1, the terminal retaining portion, formed at the first housing, abuts against the second housing to thereby effect the secondary retaining, and by doing so, the terminal received in the first housing can be retained in a double manner without directly retaining this terminal. Therefore, even when the two terminals, received respectively in the terminal receiving chambers of the one and other housings, are disposed in the respective positions coinciding with each other with respect to the longitudinal direction, both of the two terminals can be retained in a double manner. Therefore, common mating terminals can be used for connection to both of the one and other housings, so that the cost can be reduced. And besides, both of the terminals, received respectively in the terminal receiving chambers of the one and other housings, can be retained in a double manner, thereby enhancing the reliability.

In the invention of claim 2, when the terminal, received in the first housing, is in a half-inserted condition, that is, when the terminal is not retained by the terminal retaining portion, the terminal retaining portion is elastically deformed toward the second housing, and the terminal retaining portion and the second housing fail to properly abut against each other, so that the first housing can not be locked to the second housing by the retaining portions. On the other hand, when the terminal, received in the second housing, is in a half-inserted condition, that is, when the terminal is not retained by the retaining projection, the retaining projection can not be inserted into the proper retaining position, and therefore the one and other housings can not be locked to each other by the retaining portions, and therefore such half-inserted condition of each terminal can be detected.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
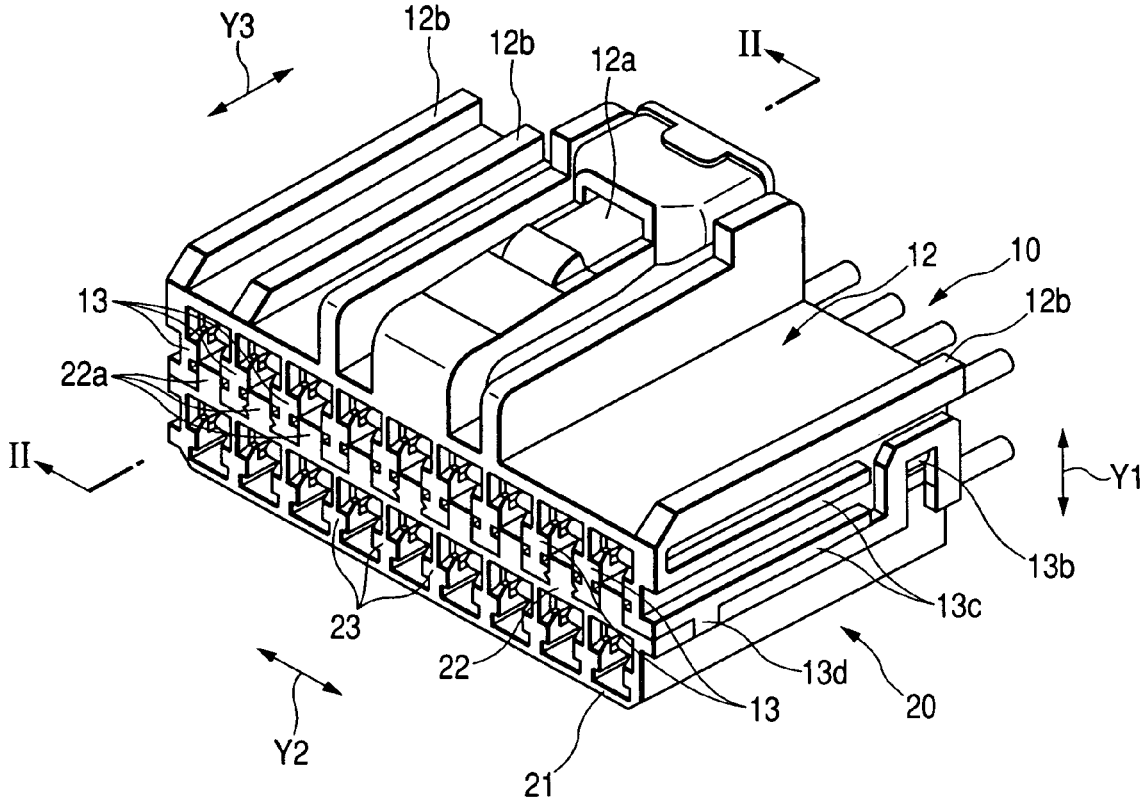
FIG. 1 is a perspective view of one preferred embodiment of a combined connector of the present invention.
Figure 2:
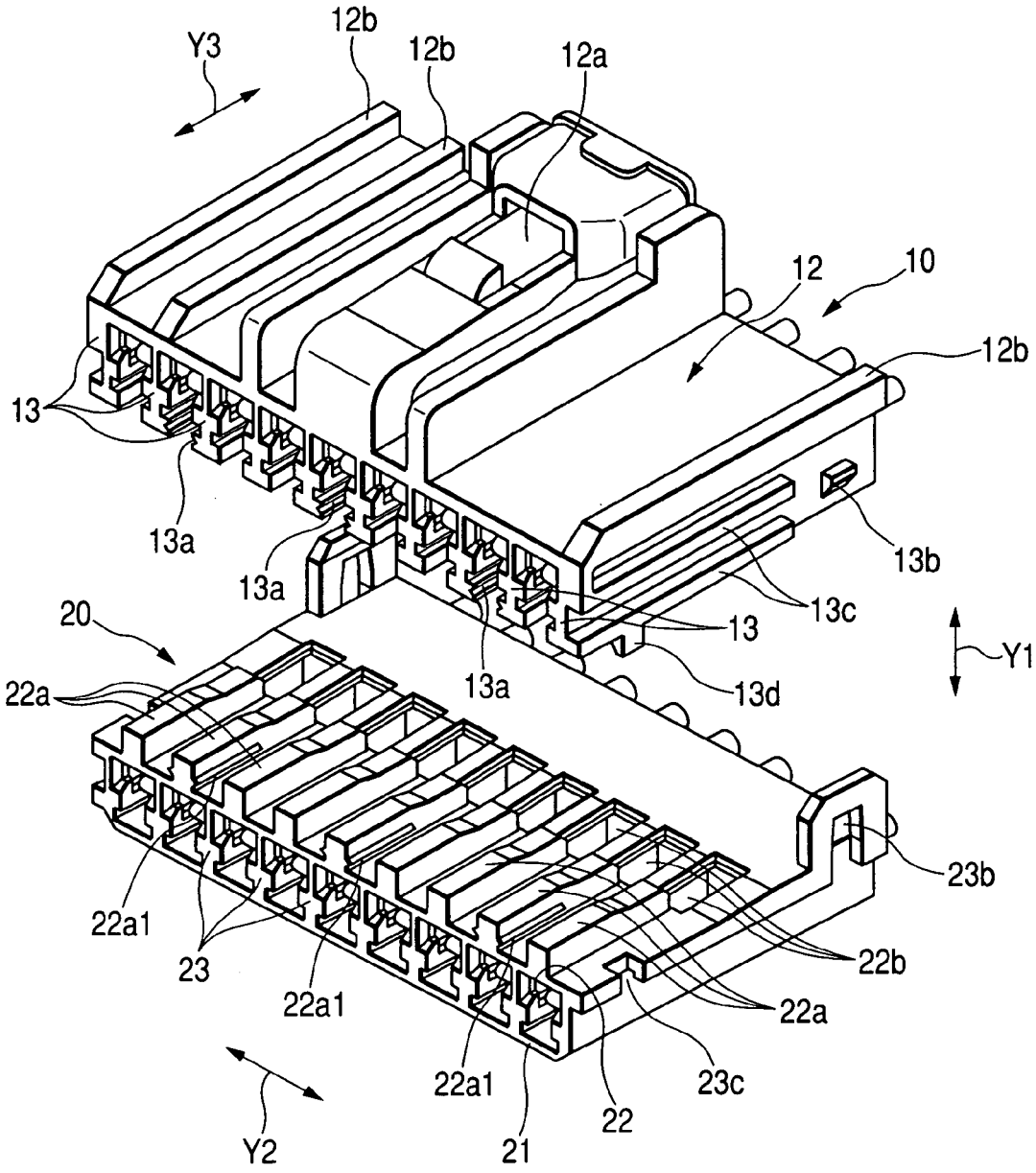
FIG. 2 is an exploded, perspective view of the combined connector of FIG. 1.
Figure 3:
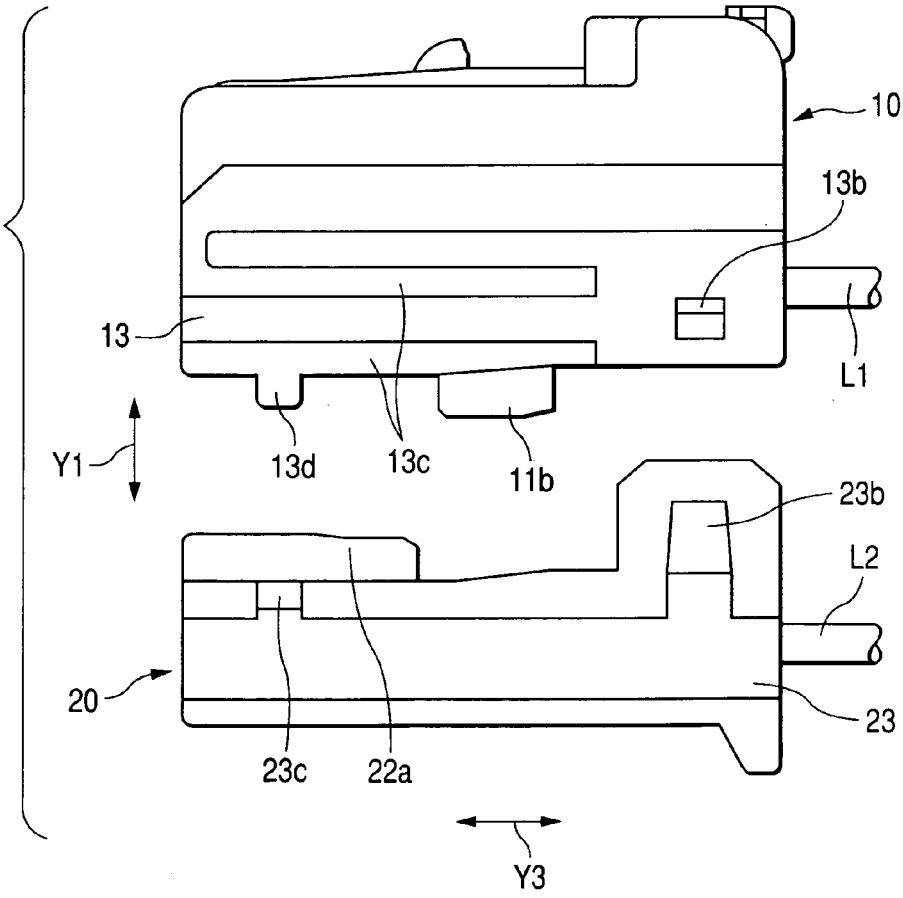
FIG. 3 is a side-elevational view of the combined connector of FIG. 2.
Figure 4:
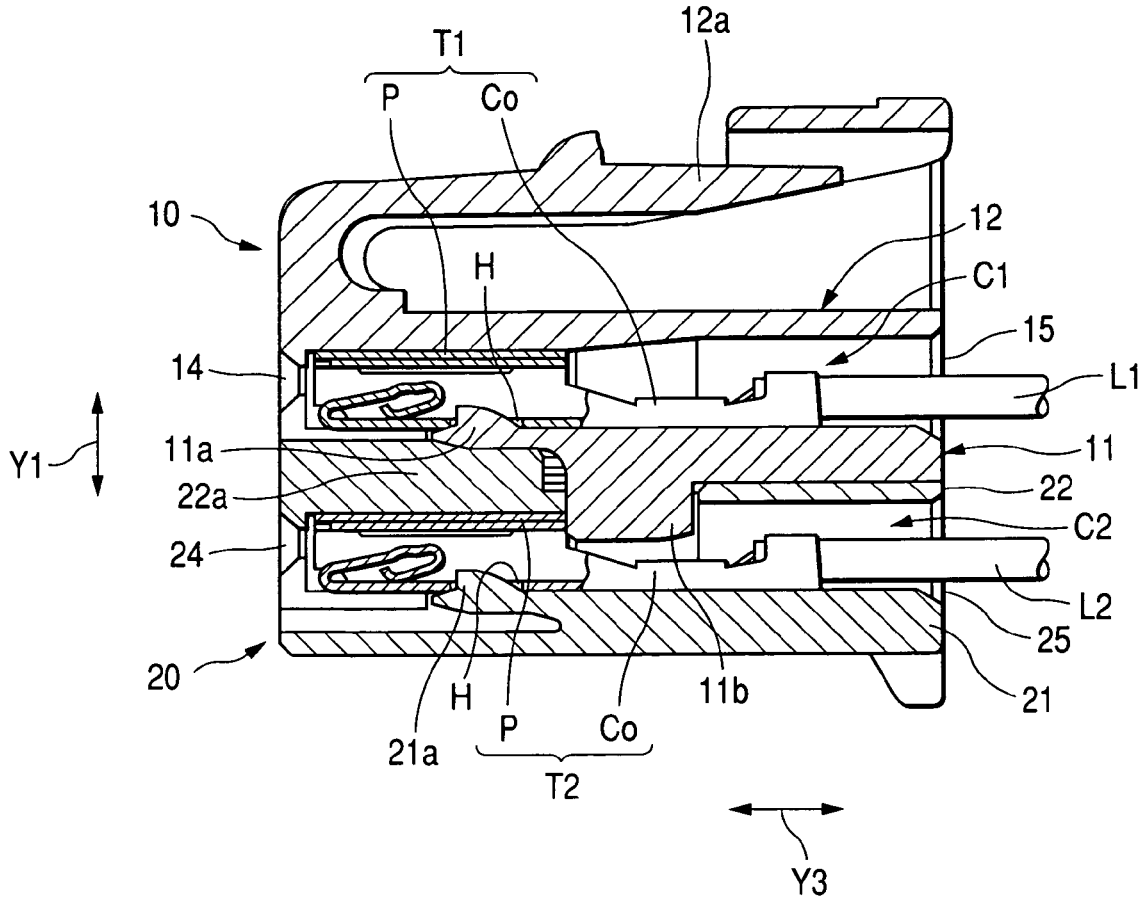
FIG. 4 is a cross-sectional view of the combined connector taken along the line II-II of FIG. 1.
Figure 5:
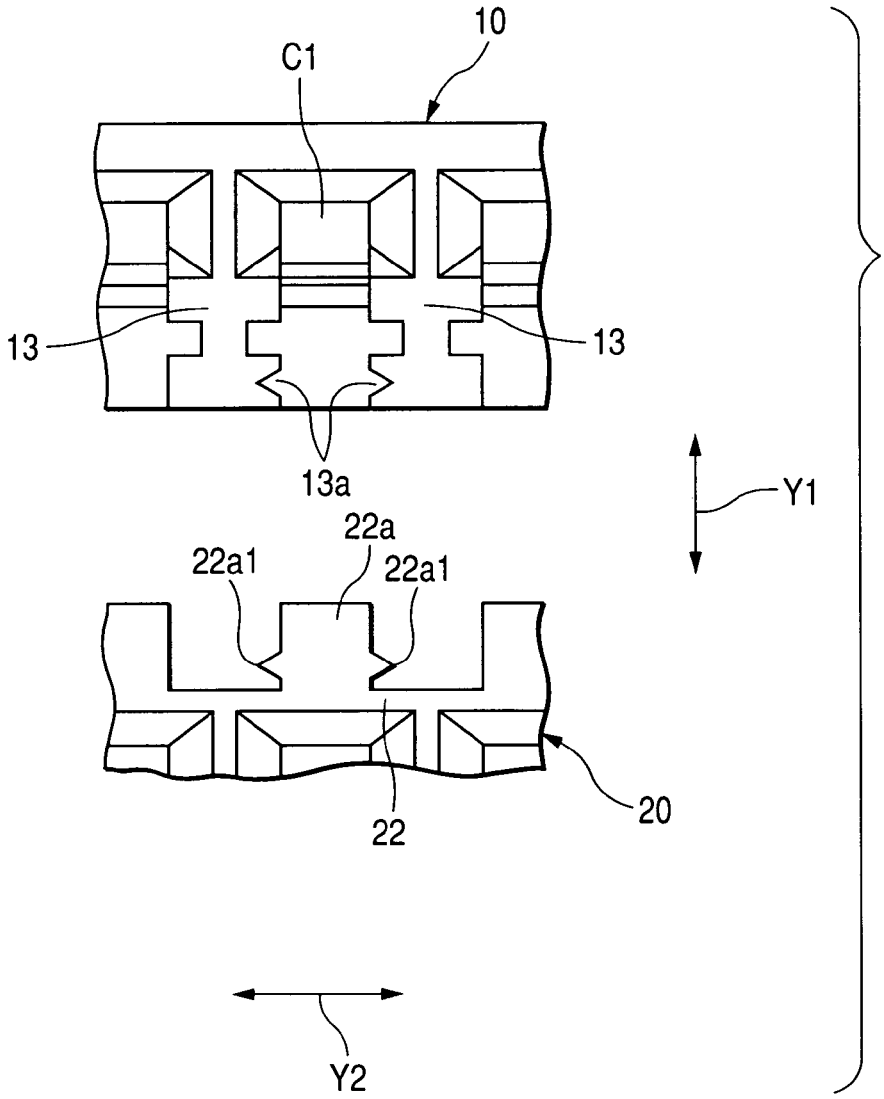
FIG. 5 is a front-elevational view of a portion of the combined connector of FIG. 2.
Figure 6:
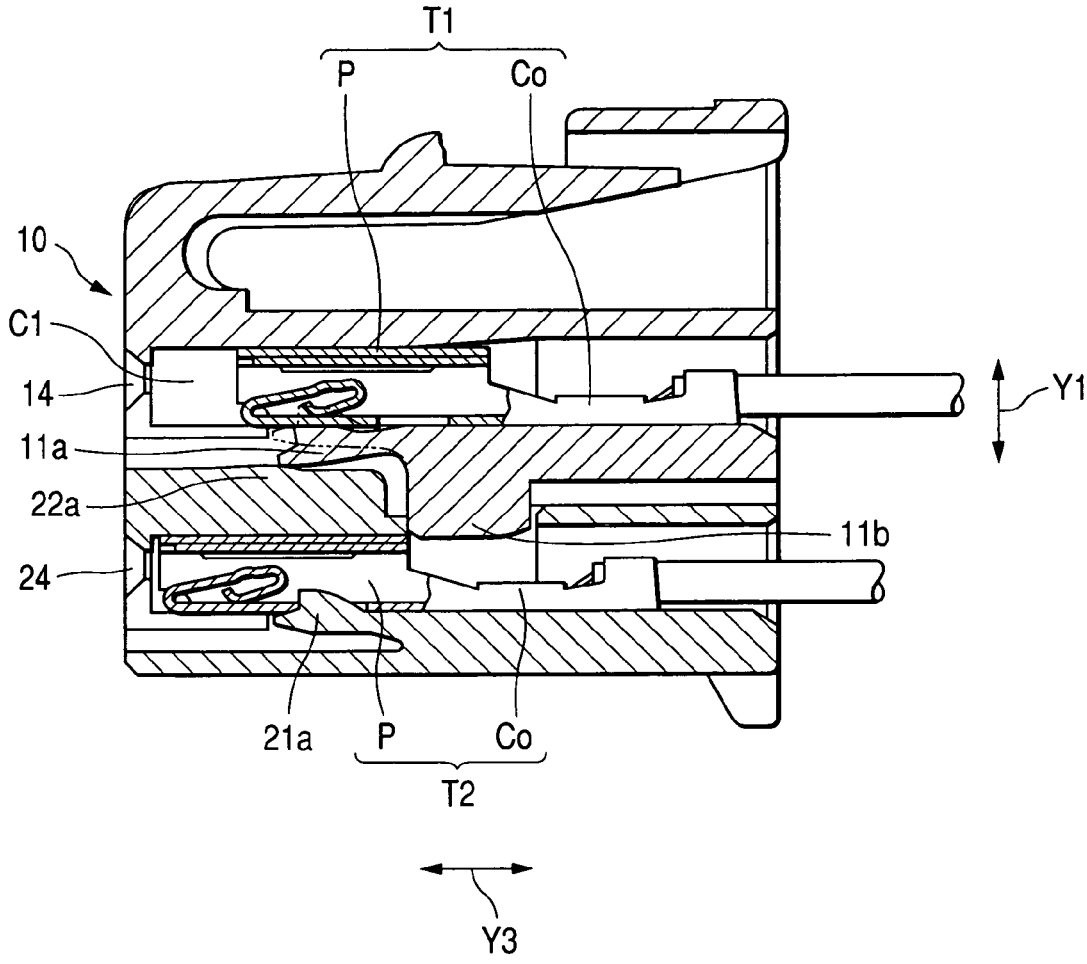
FIG. 6 is a partly cross-sectional view of the combined connector taken along the line II-II of FIG. 1, showing a half-inserted condition of a female terminal T1.
Figure 7:
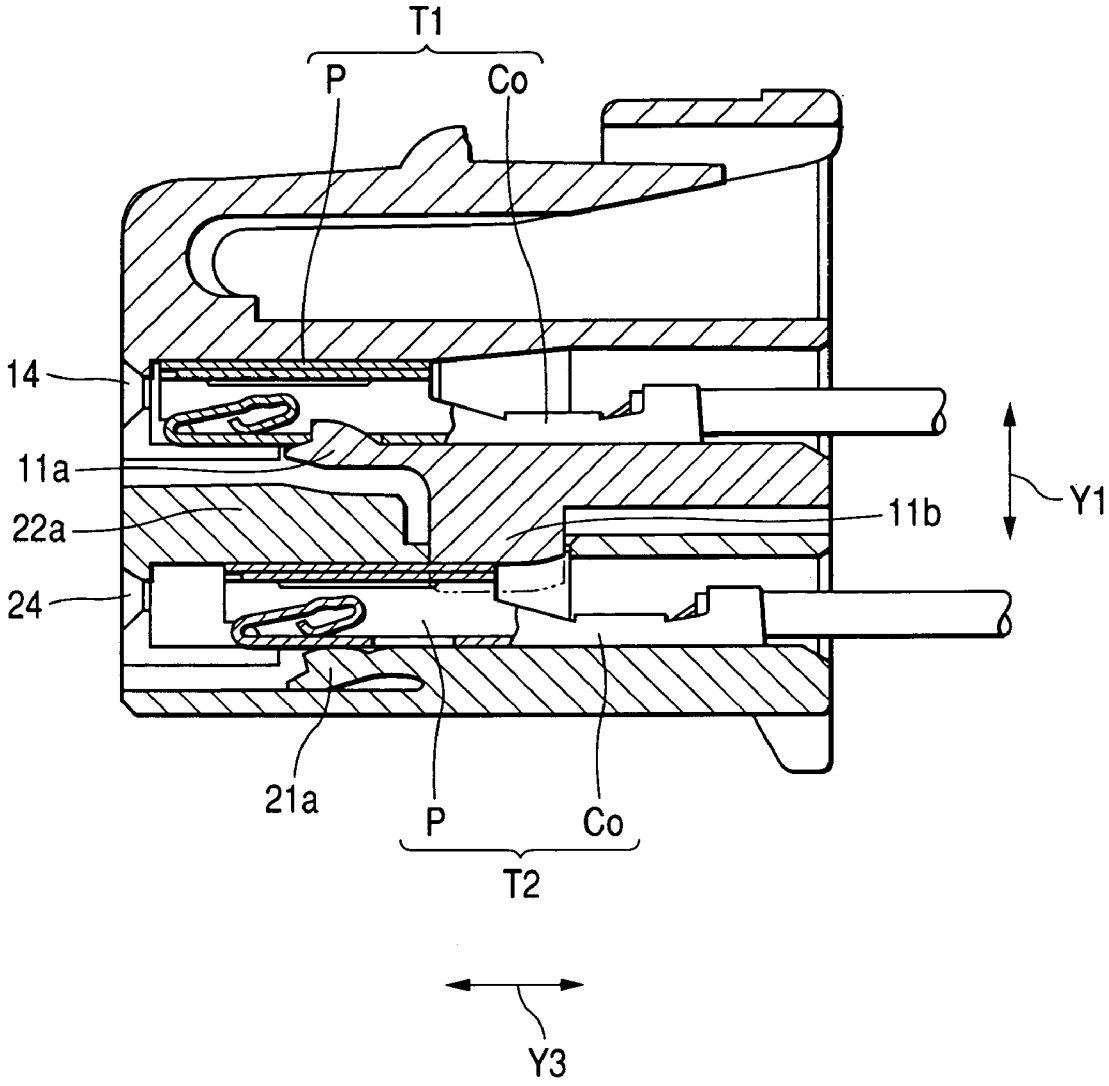
FIG. 7 is a partly cross-sectional view of the combined connector taken along the line II-II of FIG. 1, showing a half-inserted condition of a female terminal T2.
Figure 8:
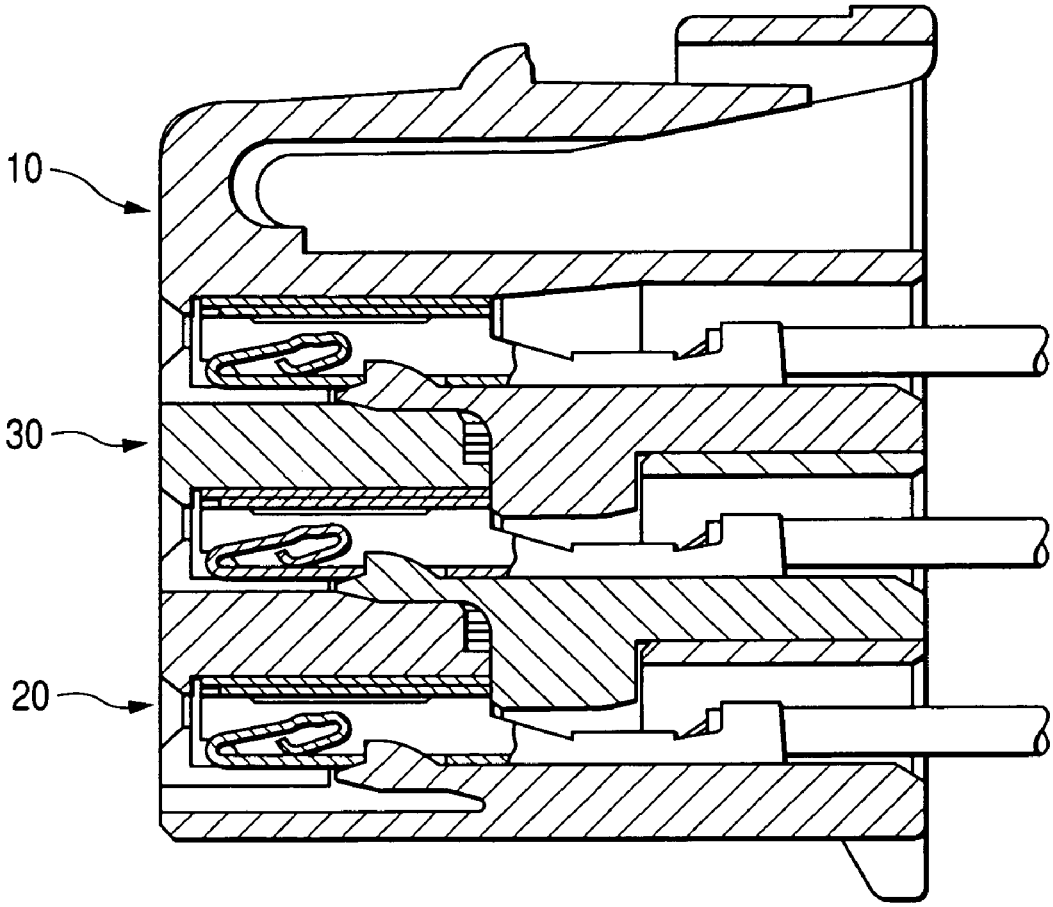
FIG. 8 is a cross-sectional view showing another embodiment of a combined connector of the invention.
Figure 9:
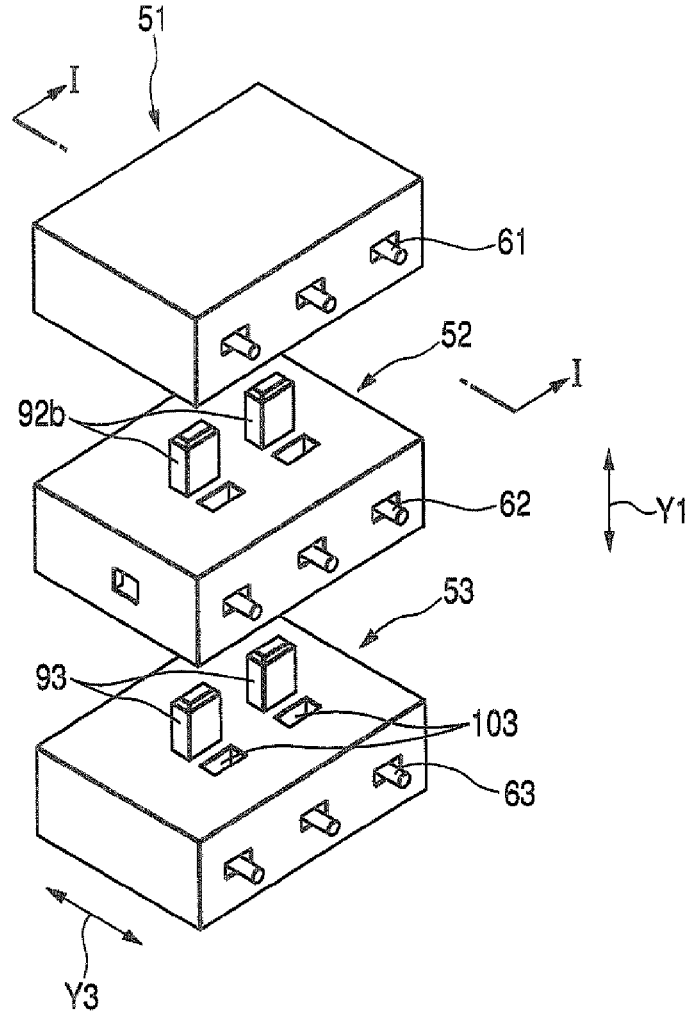
FIG. 9 PRIOR ART
FIG. 9 is an exploded, perspective view of one related joint connector.
Figure 10:
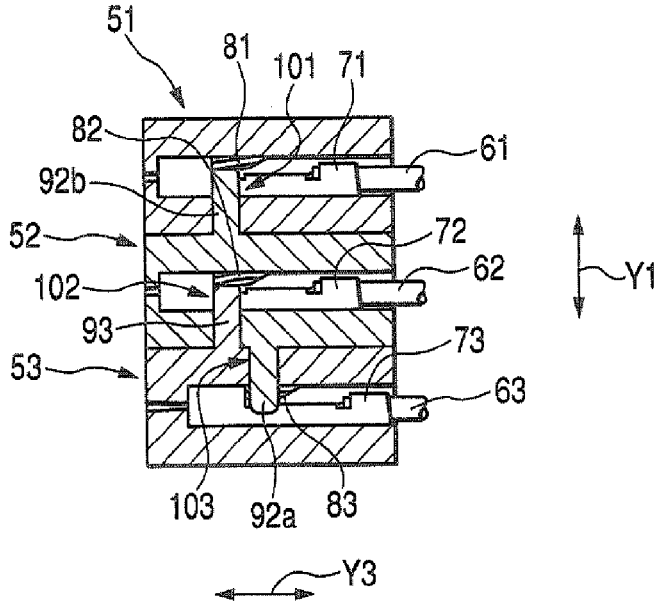
FIG. 10 PRIOR ART
FIG. 10 is a cross-sectional view of the joint connector taken along the line I-I of FIG. 9.

A preferred embodiment of the present invention will now be described with reference to the drawings. FIG. 1 is a perspective view of one preferred embodiment of a combined connector of the invention, and FIG. 2 is an exploded, perspective view of the combined connector of FIG. 1. FIG. 3 is a side-elevational view of the combined connector of FIG. 2, and FIG. 4 is a cross-sectional view of the combined connector taken along the line II-II of FIG. 1, and FIG. 5 is a front-elevational view of a portion of the combined connector of FIG. 2. FIG. 6 is a partly cross-sectional view of the combined connector taken along the line II-II of FIG. 1, showing a half-inserted condition of a female terminal T1, and FIG. 7 is a partly cross-sectional view of the combined connector taken along the line II-II of FIG. 1, showing a half-inserted condition of a female terminal T2. FIG. 8 is a view showing another embodiment of a combined connector of the invention.

As shown in FIGS. 1 to 5, this combined connector comprises a synthetic resin-molded upper housing (one housing) 10 having terminal receiving chambers C1 (FIGS. 4 and 5), and a synthetic resin-molded lower housing (the second housing) 20 having terminal receiving chambers C2 (FIG. 4), and the upper housing 10 and the lower housing 20 are stacked together. The terminal receiving chambers C1 are formed in a juxtaposed manner in the upper housing 10, and the terminal receiving chambers C2 equal in number to the terminal receiving chambers C1 are formed in a juxtaposed manner in the lower housing 20. In this embodiment, for example, nine terminal receiving chambers C1, C2 are formed in each of the upper and lower housings.

As shown in FIG. 4, female terminals T1 each fixedly secured to an end portion of a wire L1 are received respectively in the terminal receiving chambers C1 in the upper housing 10, and female terminals T2 each fixedly secured to an end portion of a wire L2 are received respectively in the terminal receiving chambers C2 in the lower housing 20.

First, the construction of the upper housing 10 will be described. The upper housing 10 has a generally box-shape, and mainly includes a lower wall 11 (FIG. 4) defining a lower housing (20) side-surface of the terminal receiving chambers C1 in a stacking direction Y1, an upper wall 12 defining an upper housing (10) side-surface of the terminal receiving chambers C1 in the stacking direction Y1, and a plurality of partition walls 13 separating the terminal receiving chambers C1 from one another in a juxtaposing direction Y2. As shown in FIG. 4, mating terminal insertion ports 14 for the insertion of male terminals (not shown) for fitting in the respective female terminals T1 are formed in a front end wall of the upper housing 10 disposed adjacent to the front sides of the female terminals T1 in the longitudinal direction Y3. Receiving terminal insertion ports 15 for inserting the female terminals T1 into the respective terminal receiving chambers C1 are formed in a rear end wall of the upper housing in the longitudinal direction Y3.

First terminal retaining lances (terminal retaining portions) 11*a* of an elastic nature are formed on a front end portion of the lower wall 11 on which the front end portions (in the longitudinal direction Y3) of the female terminals T1 are disposed, and these lances 11*a* project away from the lower housing 20 as these lances 11*a* extend toward the front end of the upper housing. First retaining projections (retaining projections) 11*b* are formed on the lower wall 11, and are disposed rearwardly of the first terminal retaining lances 11*a* in the longitudinal direction Y3, and project from the upper housing 10 toward the lower housing 20. These first retaining projections 11*b* are inserted into the respective terminal receiving chambers C2 of the lower housing 20 to retain the female terminals T2 received in the respective terminal receiving chambers C2, thereby preventing the withdrawal of the female terminals T2. The first terminal retaining lances 11*a* are provided respectively in the terminal receiving chambers C1. The first retaining projections 11*b* are provided respectively for the terminal receiving chambers C2.

The first terminal retaining lances 11*a* are so disposed that when the upper and lower housings 10 and 20 are stacked together, second retaining projections 22*a* (described later) of the lower housing 20 abut respectively against these first terminal retaining lances 11*a* as shown in FIG. 4. Namely, the first terminal retaining lances 11*a* are formed on the lower wall 11 (on which the first retaining projections 11*b* are also formed) opposed to the lower housing 20 so that these first terminal retaining lances 11*a* can abut respectively against the second retaining projections (protrusion) 22*a*.

As shown in FIG. 1, a retaining lock portion 12*a* for retaining a mating connector housing (not shown) fitted to the combined connector, as well as guide ridges 12*b* for guiding the combined connector relative to the mating connector housing in the longitudinal direction Y3, are formed on an upper surface (in the stacking direction Y1) of the upper wall 12 of the upper housing 10.

As shown in FIGS. 2 and 5, front end retaining grooves (retaining portions) 13*a* for retaining engagement with front end retaining projections (retaining portions) 22*a*1 (described later) of the lower housing 20 are formed in front end portions (in the longitudinal direction Y3) of part of the plurality of partition walls 13, and extend in the longitudinal direction Y3. Among the plurality of partition walls 13, the two outermost partition walls 13, disposed respectively at the opposite sides (in the juxtaposing direction Y2) of the upper housing 10, each has a rear end retaining projection (retaining portion) 13*b* (for retaining engagement with a rear end retaining groove (retaining portion) 23*b* (described later)) of the lower housing 20) formed on a rear end portion (in the longitudinal direction Y) of an outer surface thereof. Also, guide projections 13*c* for guiding the upper housing 10 relative to the mating connector housing in the longitudinal direction Y3 are formed on the outer surface of each of the two outermost partition walls 13. Further, positioning projections 13*d* for positioning the upper and lower housings 10 and 20 relative to each other when stacking the two housings 10 and 20 together are formed respectively on lower housing (20)-side portions (in the stacking direction Y1) of the two outermost partition walls 13 among the plurality of the partition walls 13.

Next, the construction of the lower housing 20 will be described. The lower housing 20 has a generally box-shape, and mainly includes a lower wall 21 (FIG. 4) defining a lower housing (20) side-surface of the terminal receiving chambers C2 in the stacking direction Y1, an upper wall 22 defining an upper housing (10) side-surface of the terminal receiving chambers C2 in the stacking direction Y1, and a plurality of partition walls 23 separating the terminal receiving chambers C2 from one another in the juxtaposing direction Y2. As shown in FIG. 4, mating terminal insertion ports 24 for the insertion of male terminals (not shown) for fitting in the respective female terminals T2 are formed in a front end wall of the lower housing 20 disposed adjacent to the front sides of the female terminals T2 in the longitudinal direction Y3. Receiving terminal insertion ports 25 for inserting the female terminals T2 into the respective terminal receiving chambers C2 are formed in a rear end wall of the lower housing in the longitudinal direction Y3.

Second terminal retaining lances 21*a* of an elastic nature are formed on a front end portion of the lower wall 21 on which the front end portions (in the longitudinal direction Y3) of the female terminals T2 are disposed, and these lances 21*a* project toward the upper housing 10 as these lances 21*a* extend toward the front end of the lower housing. The second terminal retaining lances 21*a* are provided respectively in the terminal receiving chambers C2.

The second retaining projections 22*a* for abutting against the respective first terminal retaining lances 11*a* on the upper housing 10 are formed on the upper housing (10)-side surface (in the stacking direction Y1) of the front end portion (in the longitudinal direction Y3) of the upper wall 22*a*, and project toward the upper housing 10 in the stacking direction Y1. These second retaining projections 22*a* are provided respectively for the terminal receiving chambers C1. Further, projection insertion holes 22*b* for the insertion of the first retaining projections 11*b* of the upper housing 10 thereinto are formed in the upper housing (10)-side surface (in the stacking direction Y1) of the upper wall 22, and are disposed adjacent respectively to rear ends (in the longitudinal direction Y3) of the second retaining projections 22*a*, as shown in FIG. 2.

As shown in FIGS. 2 and 5, the front end retaining projections 22*a*1 for retaining engagement with the front end retaining grooves 13*a* in the upper housing 10 are formed on front end portions (in the longitudinal direction Y3) of part of the plurality of second retaining projections 22*a*, and extend in the longitudinal direction Y3. Among the plurality of partition walls 23, the two outermost partition walls 23, disposed respectively at the opposite sides (in the juxtaposing direction Y2) of the lower housing 20, each has the rear end retaining groove 23*b* (for retaining engagement with the rear end retaining projection 13*b* of the upper housing 10) formed in a rear end portion (in the longitudinal direction Y) of an outer surface thereof. Further, positioning grooves 23*c* (FIGS. 2 and 3) for positioning the upper and lower housings 10 and 20 relative to each other when stacking the two housings 10 and 20 together are formed respectively in upper housing (10)-side portions (in the stacking direction Y1) of the two outermost partition walls 23 among the plurality of the partition walls 23.

As is clear from FIG. 4, when the upper and lower housings 10 and 20 are stacked together in a retained condition, the first terminal retaining lances 11*a* are disposed in registry with the second terminal retaining lances 21*a* in the stacking direction Y1. In other words, the female terminals T1 and T2 of the same type are received in the respective positions coinciding with each other with respect to the longitudinal direction Y3.

The female terminals T1 and the female terminals T2 have the same configuration as shown in FIG. 4, and each of the female terminals T1 and T2 includes a tubular portion P for receiving the male terminal, and a connection portion Co connected by pressing to the wire L1, L2. As is clear from FIG. 4, the height of the tubular portion P is larger than the height of the connection portion Co, and a step portion is formed at a rear end of the tubular portion P. A retaining hole H is formed in the tubular portion P, and part of the first/second terminal retaining lance 11*a*, 21*a* is inserted into this retaining hole H.

Next, a method of assembling the combined connector of the above construction will be described. First, before stacking the upper and lower housings 10 and 20 together, the female terminals T1 are inserted respectively into the terminal receiving chambers C1, while the female terminals T2 are inserted respectively into the terminal receiving chambers C2. Each female terminal T1 is inserted into the terminal receiving chamber C1 through the receiving terminal insertion port 15 formed in the rear end of the upper housing 10, and is advanced along the lower wall 11*a* toward the front end of the upper housing. When the tubular portion P of the female terminal T1 advances to the first terminal retaining lance 11*a*, the first terminal retaining lance 11*a* is elastically deformed toward the lower housing 20 in the stacking direction Y.

When the female terminal T1 is further advanced, so that its retaining hole H reaches the first terminal retaining lance 11*a*, the first terminal retaining lance 11*a* is restored toward the upper housing 10 in the stacking direction Y1, and is inserted into the retaining hole H. As a result, the first terminal retaining lance 11*a* effects primary retaining of the female terminal T1, and thus the female terminal T1 is received and held in the terminal receiving chamber C1. In a similar manner described above for the female terminal T1, when each female terminal T2 is inserted into the terminal receiving chamber C2 through the receiving terminal insertion port 25, the female terminal T2 is retained by the second terminal retaining lance 21*a* in a primary manner, and is received and held in the terminal receiving chamber C2.

Then, the upper and lower housings 10 and 20 are combined together. First, the positioning projections 13*d* are mated respectively with the positioning grooves 23*c* in the lower housing 20, and then the upper housing 10 is turned or pivotally moved about the positioning projections 13*d*. Namely, the rear end of the upper housing 10 is moved toward the lower housing 20 in the stacking direction Y1, thereby inserting the first retaining projections 11*b* into the respective projection insertion holes 22*b*. When the first retaining projections 11*b* are further inserted into the respective projection insertion holes 22*b* toward the lower housing 20 in the stacking direction Y1, the rear end retaining projections 13*b* of the upper housing 10 are inserted respectively into the rear end retaining grooves 23*b* of the lower housing 20, and also the front end retaining projections 22*a*1 of the lower housing 20 are inserted respectively into the front end retaining grooves 13*a* of the upper housing 10, so that the upper housing 10 and the lower housing 20 are locked or retained to each other.

When the upper and lower housings 10 and 20 are thus locked together, each of the first retaining projections 11*b* inserted in the corresponding terminal receiving chamber C2 as shown in FIG. 4, and is retainingly engaged with the step portion of the female terminal T2 provided between the tubular portion P and the connection portion Co, thereby effecting secondary retaining of the female terminal T2. Also, each of the second retaining projections 22*a* abuts against the lower housing (20)-side surface of the corresponding first terminal retaining lance 11*a* in the stacking direction Y1. As a result, the second retaining projection 22*a* prevents the first terminal retaining lance 11*a* from being elastically deformed toward the lower housing 20 in the stacking direction Y1, thereby effecting the secondary retaining of the female terminal T1.

In the above combined connector, the first terminal retaining lance 11*a* and the second retaining projection 22*a* abut against each other, thereby effecting the secondary retaining, and therefore the double retaining can be effected without retaining the first terminal retaining lance 11*a* directly by the second retaining projection 22*a*. Therefore, even when the female terminals T1 and the female terminals T2 are disposed in the respective positions coinciding with each other with respect to the longitudinal direction Y3, the female terminals T1 as well as the female terminals T2 can be retained in a double manner. Therefore, common male terminals for fitting into the female terminals T1 and T2 can be used for connection to both of the upper and lower housings 10 and 20, so that the cost can be reduced. And besides, the female terminals T1 received in the terminal receiving chambers C1 of the upper housing 10, as well as the female terminals T2 received in the terminal receiving chambers C2 in the lower housing 20, can be retained in a double manner, thereby enhancing the reliability.

Incidentally, when the female terminal T1, received in the terminal receiving chamber C1 of the upper housing 10, is in a half-inserted condition, that is, when the first terminal retaining lance 11*a* does not reach the retaining hole H of the female terminal T1, the first terminal retaining lance 11*a* is elastically deformed from a retaining position (indicated in a broken line in FIG. 6) toward the lower housing 20 in the stacking direction Y1.

In this condition, the first terminal retaining lance 11*a* and the second retaining projection 22*a* fail to properly abut against each other, so that the rear end retaining projections 13*b* can not be retainingly engaged in the respective rear end retaining grooves 23*b*. Also, the front end retaining projections 22*a*1 can not be retainingly engaged in the respective front end retaining grooves 13*a*. Therefore, such a half-inserted condition of the female terminal T1 can be detected at the time of stacking the upper and lower housings 10 and 20 together.

On the other hand, when the female terminal T2, received in the terminal receiving chamber C2 of the lower housing 20, is in a half-inserted condition, that is, when the second terminal retaining lance 21*a* does not reach the retaining hole H of the female terminal T2, the first retaining projection 11*b* is displaced from a retaining position (indicated by a broken line in FIG. 7) toward the upper housing 10 in the stacking direction Y1, and abuts against the tubular portion P of the female terminal T2. Therefore, the rear end retaining projections 13*b* can not be retainingly engaged in the respective rear end retaining grooves 23*b*. Also, the front end retaining projections 22*a*1 can not be retainingly engaged in the respective front end retaining grooves 13*a*.

Therefore, such a half-inserted condition of the female terminal T2 can also be detected at the time of stacking the upper and lower housings 10 and 20 together.

In the above embodiment, the upper and lower housings 10 and 20 are stacked together in a two-stage manner. However, the invention is not limited to this construction, and for example an upper housing 10, an intermediate housing 30 and a lower housing 20 can be stacked together in a three-stage manner as shown in FIG. 8. Namely, the invention can be achieved in so far as the combined connector of the invention comprises at least one pair of housings. With respect to the three-stage structure shown in FIG. 8, the upper housing 10 corresponds to one housing of the adjacent housings 10 and 30, while the intermediate housing 30 corresponds to the other housing. And, the intermediate housing 30 corresponds to one housing of the adjacent housings 30 and 20, while the lower housing 20 corresponds to the other housing.

In the above embodiment, each of the second terminal retaining lances 21*a*, formed at the lower housing 20, projects toward the upper housing 10 in the stacking direction Y1 within the terminal receiving chamber C2. However, the direction of projecting of the second terminal retaining lance 21*a* is not limited to this direction, and for example each second terminal retaining lance can project in the juxtaposing direction Y2 or away from the upper housing 10 in the stacking direction Y1. However, in the case where three or more housings are stacked together as is the case with the structure of FIG. 8, the terminal retaining lances need to project toward the upper housing 10 in the stacking direction Y1, since the intermediate housing 30, interposed between the upper and lower housings 10 and 20, functions not only as the first housing but also as the other housing.

In the above embodiment, the female terminals T1 and T2 are received in the respective terminal receiving chambers C1 and C2. However, the invention is not limited to this construction, and any other suitable terminals such for example of male terminals can be received.

In the above embodiment, the upper and lower housings 10 and 20 have the same number of (that is, nine) terminal receiving chambers C1, C2. However, the invention is not limited to this construction, and the terminal receiving chambers C1 in the upper housing 10 may be different in number from the terminal receiving chambers C2 in the lower housing 20. In this case, the first retaining projections 11*b*, corresponding in number to the terminal receiving chambers C2 in the lower housing 20, are formed at the upper housing 10, while the second retaining projections 22*a*, corresponding in number to the terminal receiving chambers C1 in the upper housing 10, are formed at the lower housing 20.

In the above embodiment, the plurality of terminal receiving chambers C1 are formed in a juxtaposed manner in the upper housing 10, and the plurality of terminal receiving chambers C2 are formed in a juxtaposed manner in the lower housing 20. However, the invention is not limited to such a construction, and for example one terminal receiving chamber C1 may be formed in the upper housing 10, and one terminal receiving chamber C2 may be formed in the lower housing 20.

In the above embodiment, the first terminal retaining lances 11*a* abut against the respective second retaining projections 22*a*. However, in the invention, the first terminal retaining lances 11*a* need only to abut against the lower housing 20 in the stacked condition of the upper and lower housings 10 and 20, and may not abut against such retaining projections. For example, the connector can be so constructed that the first terminal retaining lances 11*a* abut against the flat upper wall 22 of the lower housing 20.

The above embodiment has been given merely as one representative form of the invention, and the invention is not limited to the above embodiment, and various modifications can be made without departing from the subject matter of the invention.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japan Patent Application No. 2005-280066 filed on Sep. 27, 2006, the contents of which are incorporated herein for reference.

What is claimed is:

1. A combined connector, comprising:

a first housing that has a first terminal receiving chamber for receiving a first terminal; and a second housing that is stacked on the first housing and has a second terminal receiving chamber for receiving a second terminal;

wherein the first housing includes:

a retaining projection which projects into the second terminal receiving chamber to retain the second terminal in the second terminal receiving chamber; and a terminal retaining portion which retains the first terminal received in the first terminal receiving chamber and is disposed so as to contact with the second housing in a state that the first housing and the second housing are stacked together.

2. The combined connector according to claim 1, wherein the first housing and the second housing respectively include engagement portions that are provided on regions vicinity of the retaining projection and the terminal retaining portion; and wherein the engagement portions are retainingly engaged with each other.

3. The combined connector according to claim 2, wherein the engagement portions are respectively provided on a partition wall of the first terminal receiving chamber and a part of the second housing corresponding to the partition wall of the first terminal receiving chamber in the state that the first housing and the second housing are stacked together.

4. The combined connector according to claim 1, wherein the second housing includes a protrusion which is disposed so as to be pressed in contact with the terminal retaining portion of the first housing in a state that the first housing and the second housing are stacked together.

5. The combined connector according to claim 1, wherein said terminal retaining portion is disposed on a wall of the first housing that borders the second housing.

* * * * *